US007036394B2

(12) United States Patent
Early

(10) Patent No.: US 7,036,394 B2
(45) Date of Patent: May 2, 2006

(54) WIRE WINDING TOOL ARTICLE AND METHOD

(75) Inventor: Senora Early, Medford, OR (US)

(73) Assignee: Senora Early DBA Clamptite-Ray Silvey Company, Anaheim, CA (US)

( * ) Notice: Subject to any disclaimer, the term of this patent is extended or adjusted under 35 U.S.C. 154(b) by 0 days.

(21) Appl. No.: 10/886,018

(22) Filed: Jul. 6, 2004

(65) Prior Publication Data

US 2006/0005666 A1 Jan. 12, 2006

(51) Int. Cl.
*B25B 25/00* (2006.01)

(52) U.S. Cl. ..... 81/9.3; 24/27

(58) Field of Classification Search ..... 81/9.3; 24/27

See application file for complete search history.

(56) References Cited

U.S. PATENT DOCUMENTS 1,012,282 A * 12/1911 Schlangen ..... 81/9.3
1,078,533 A * 11/1913 Beaudette ..... 81/9.3
1,347,579 A * 7/1920 Bernhardt ..... 81/9.3
1,453,940 A * 5/1923 Lowery ..... 81/9.3
1,783,123 A * 11/1930 Kiviaho ..... 81/9.3
2,362,112 A * 11/1944 Benedetto ..... 81/9.3
2,421,878 A * 6/1947 Gubser ..... 81/9.3
4,084,625 A * 4/1978 Brinegar ..... 140/123.5
4,794,827 A * 1/1989 Poling ..... 81/125
4,997,194 A * 3/1991 Krohn ..... 279/149
5,090,277 A * 2/1992 Spiller ..... 81/488
5,148,577 A * 9/1992 Silvey ..... 24/27

* cited by examiner

*Primary Examiner*—David B. Thomas
(74) *Attorney, Agent, or Firm*—Fulwider Patton

(57) ABSTRACT

In an article and method for enabling a wire winding tool to wind a loop of wire about a workpiece and secure the wire loop to the workpiece, the wire winding tool includes a body element which includes a tapered wire-holding end and a hollow cylindrical shaft with interior threads and side slots. The tool further includes a threaded shaft including a distal end and transverse pins which extend therefrom through the body element side slots and are moveable therein, and about which free ends of the wire are wound. Also, the tool includes a nut threadably connected to the threaded shaft, which is threadably moveable to enable the threaded shaft to retract and pull the wire free ends so as to wind and secure the wire to the workpiece.

6 Claims, 1 Drawing Sheet

WIRE WINDING TOOL ARTICLE AND METHOD

BACKGROUND OF THE INVENTION

1. Field of the Invention

The present invention relates generally to hand tools, and, more particularly, to a new and improved hand tool for enabling a wire clamp to be tightly wound about a workpiece.

2. General Background and State of the Art

It has been known to wrap a clamp about a workpiece such as a rubber hose which in turn may extend about a pipe, and to enable the clamp to be tightened about the hose and pipe to tightly bind the hose to the pipe. The clamp may include a screw which may be threadably advanced so as to tighten the clamp. It has also been known to wrap a loop of wire about the workpiece to form a wire loop clamp, and to use a hand tool to apply pressure to and tighten the wire loop. The loop of wire may include a plurality of windings of the wire about the workpiece.

However, it would be desirable to provide a hand tool which would enable effective, convenient and efficient tightening of a wire loop clamp about a workpiece.

Moreover, the tool may hang up on the wire loop upon movement of the tool thereabout in forming the wire loop clamp, interfering therewith.

Furthermore, it may be difficult to get a good grip on the tool in instances where such may be required to enable effective moving of the tool for forming and securing the wire loop clamp.

In addition, it would be desirable to enable convenient carrying of the tool.

In view of these considerations, effective winding and securing of a wire loop clamp about a workpiece may be implemented in a wire winding tool which enables efficient tightening of a wire loop clamp, effective operation of the tool without hanging up on the wire loop, and convenient carrying of the tool.

Therefore, there has existed a need for an article and method for enabling a wire clamp to be wound about a workpiece in an effective and efficient manner, while preventing interference with the wire loop clamp and enabling convenient access thereto. Accordingly, the present invention fulfills these needs by providing an efficient and effective wire loop clamp winding tool with enhanced gripping and carrying thereof.

INVENTION SUMMARY

Briefly, and in general terms, the present invention provides an article for enabling a wire clamp to be wound about a workpiece, comprising a wire winding tool, wherein the wire includes opposed free ends, and is able to form a loop, and is further able to form a winding which is extendable about the workpiece and through the loop, and to be wound about and secured to the workpiece.

More particularly, the present invention includes a body element, which includes a distal end which is generally tapered-shaped to form a tapered end, able to hold the wire loop in position during winding of the wire, and a cylindrical shaft, which is hollow, and includes interior threads and side slots, and from which the tapered end extends.

The article, in accordance with the present invention, also includes a threaded shaft, extendable in and threadably engageable with the interior threads of the hollow portion of the cylindrical shaft, and threadably movable relative to the body element, which threaded shaft includes a distal end, and transverse pins extending therefrom through the side slots in the body element, moveable in the body element side slots and able to enable the wire free ends to be secured thereto.

The article of the present invention further includes a nut, threadably connected to the threaded shaft, and, upon threaded movement of the nut, able to enable the threaded shaft to retract relative to the body element such that the transverse pins pull on the wire free ends secured thereto so as to wind the wire about the workpiece and enable the wire winding to be secured to the workpiece.

Therefore, one aspect of the present invention is that it provides a wire winding tool for effectively forming and securely winding a wire loop clamp about a workpiece.

Another aspect of the present invention is that it includes a unitary cylindrical shaft for preventing the tool from hanging up on the wire loop clamp during movement thereof.

A further aspect of the present invention is that it includes gripping-enabling surfaces and threadable movement-enabling members to enable effective gripping and tightening movement of the tool.

Still another aspect of the invention is that it enables the tool to be connected to a loop for convenient carrying thereof.

These and other aspects and features of the invention will become apparent from the following more detailed description, when taken in conjunction with the accompanying drawings of illustrative embodiments.

DETAILED DESCRIPTION OF THE PREFERRED EMBODIMENTS

Figure 1:
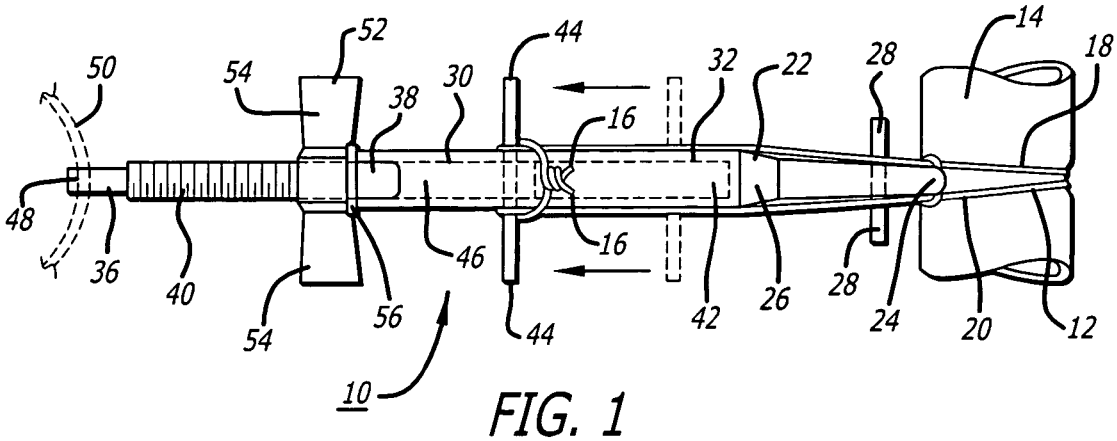
FIG. 1 is an elevational partly-fragmentary view of a wire winding tool and a wire wound about a workpiece in accordance with the present invention.

The present invention is directed to an improved article and method for providing a wire winding tool, which is able to wind a formed loop clamp securely about a workpiece in an effective and efficient manner.

Referring to the drawings, wherein like numerals denote like or corresponding parts, and in particular to FIGS. 1–4, there is shown an article 10 for enabling a wire 12 to be wound about a workpiece 14, comprising a wire winding tool, wherein the wire 12 includes opposed free ends 16, and is able to form a loop 18, and is further able to form a winding 20, extendable about the workpiece 14 and through the loop 18 and able to be wound about and secured to the workpiece 14.

The tool 10 may be utilized for emergency repairs or permanent fixes. It is lightweight, substantially lighter than worm gear and tension clamps. The wire 12 for example may be comprised of stainless steel, safety wire, welding, electric fence, or bailing wire. The workpiece 14 about which the wire 12 is to be wound and secured may for example comprise high pressure hose, hydraulic hose, power steering hose, broken poles, pieces of a broken tool handle, fences and gates, farm machinery, fishing poles, mufflers and tail pipes, furniture and flower pots, toys and sporting equipment, cooking pots and pans, leaky hoses, or irrigation and sprinkler systems.

In the present invention, the wire winding tool 10 includes a body element 22, which includes a distal end 24 which is generally tapered-shaped to form a tapered end 26, able to hold the wire loop 18 in position during winding of the wire 12, and guide pins 28, for guiding the wire 12 thereover. The body element 22 further includes a cylindrical shaft 30, which is hollow, and includes interior threads 32 and side slots 34, and from which the tapered end 26 extends. The side slots 34 of the body element 22 are elongated. The cylindrical shaft 30 of the body element 22 further includes a proximal end 36, which includes flat side surfaces 38 for enabling securing of a gripping member thereto.

The cylindrical shaft 30 may for example be comprised of a single unitary piece of machined stainless steel, with a gradual taper to the tapered end 26, to provide a smoother transition such that hangup of the tool 10 with the wire 12 is prevented while pivoting the tool 10. The flat side surfaces 38 enable enhanced stability in gripping and moving the tool 10.

Figure 2:
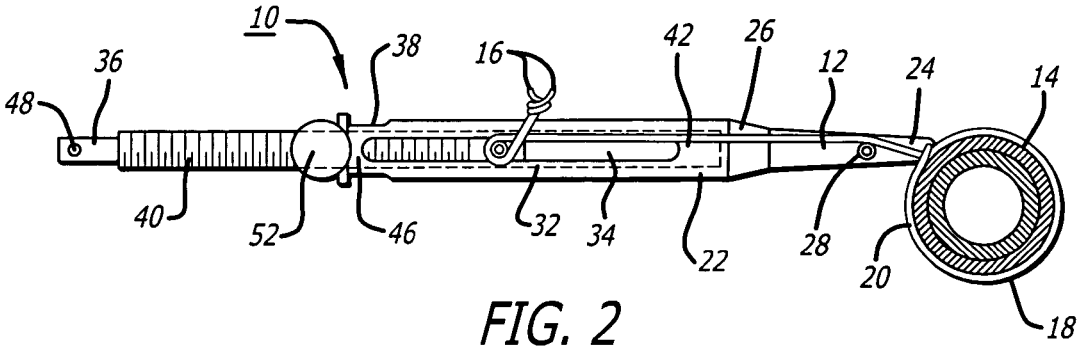
FIG. 2 is a side elevational partly-sectional view of a wire winding tool and a wire wound about a workpiece in accordance with the present invention.
Figure 3:
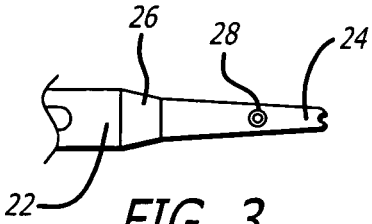
FIG. 3 is a fragmentary view of the distal end of a winding wire tool in accordance with the present invention.

As shown in FIGS. 1–2, the wire winding tool 10 further includes a threaded shaft 40, able to extend in and threadably engage the interior threads 32 of the hollow cylindrical shaft 30, and to be threadably movable relative to the body element 22. The threaded shaft 40 includes a distal end 42, and transverse pins 44 extending therefrom through the side slots 34 in the body element 22, able to be moveable in the body element side slots 34 and to enable the wire free ends 16 to be secured thereto. The threaded shaft 40 further includes a proximal end 46 which is non-threaded. The threaded shaft 40 is elongated to enable elongated movement of the transverse pins 44 in the elongated side slots 34. The non-threaded proximal end 46 of the threaded shaft 40 has a hole 48 therethrough for enabling extending a loop 50 therethrough. The loop which is extendable through the hole 46 may comprise a key ring, for enabling connection of the tool 10 thereto.

In accordance with the invention, the wire winding tool 10 also includes a nut 52, able to be threadably connected to the threaded shaft 40, and, upon threaded movement of the nut 52, to enable the threaded shaft 40 to retract relative to the body element 22, such that the transverse pins 44 pull on the wire free ends 16 secured thereto, so as to wind the wire 12 about the workpiece 14 and enable the wire winding 20 to be secured to the workpiece 14. The nut 52 includes side wing-shaped projections 54 for enabling gripping and leveraging for movement thereof. Also, the tool 10 includes a washer 56 positionable between the nut 50 and the body element 22. The washer 56 may be comprised of nylon.

As illustrated in FIGS. 1–4, in a method for use of the wire winding tool 10, the operation of the tool 10 is enabled by forming a loop, 18 and forming a winding 20 adapted to extend about the workpiece 14 and through the loop 18 and to be wound about the workpiece 14, by the wire 12. The operation is further enabled by holding the wire loop 18 in position during the winding of the wire 12, by the body element tapered end 26, and by threadably moving the threaded shaft 40 along the interior threads 32 of the cylindrical shaft hollow portion.

As seen in FIGS. 1–2, the operation of the wire winding tool 10 is further enabled by moving the threaded shaft transverse pins 44 with the wire free ends 16 secured thereto along the body element side slots 34. Moving the threaded shaft transverse pins 44 further includes moving along the elongated body element side slots 34. Moving the threaded shaft transverse pins 44 includes elongated travel of the transverse pins 44 in the elongated side slots 34 of the threaded shaft 40.

In the present invention, the operation of the tool 10 further includes threadably moving the nut 52 along the threaded shaft 40 and retracting the threaded shaft 40 relative to the body element 22, so as to pull the transverse pins 44 with the wire free ends 16 secured thereto, wind the wire 12 about the workpiece 14, and secure the wire winding 20 to the workpiece 14. Threadably moving the nut 52 further includes enabling gripping of the side wing-shaped projections 54 of the nut 52. Threadably moving the nut 52 further includes enabling moving of the washer 56.

Figure 4:
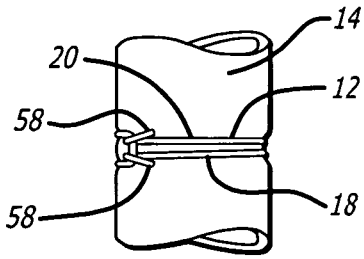
FIG. 4 is a fragmentary view of a wire loop wound about and secured to a workpiece in accordance with the present invention.

As depicted in FIG. 4, upon pulling the wire 12 tightly about the workpiece 14, the tool 10 is pivoted upwardly at the distal end 24 thereof to bend the wire 12 over the loop 18. The wire 12 is then cut off to form ends 58 which may then be pinched down over the loop 18 for securing the loop 18 to the workpiece 14.

In accordance with the invention, operation of the tool 10 also includes enabling securing of a gripping member to the flat side surfaces 38 of the proximal end 36 of the body element cylindrical shaft 30, and enabling extension of a loop 50 through the non-threaded proximal end 46 of the threaded shaft 40. Enabling extension of the loop 50 includes enabling extension thereof through the hole 48 in the non-threaded proximal end 46 of the threaded shaft 40. Forming, holding, threadably moving the threaded shaft 40, moving the threaded shaft transverse pins 44, and threadably moving the nut 52 may be enabled relative a stainless steel tool 10.

In accordance with the present invention, the system and method provide for a wire winding tool which enables the effective forming and securing of a wire loop clamp about a workpiece, which enables efficient gripping and carrying thereof.

It will be apparent from the foregoing that, while particular forms of the invention have been illustrated and described, various modifications can be made without departing from the spirit and scope of the invention. Accordingly, the invention is not to be limited, except by the following claims.

I claim:

1. An article for enabling a wire to be wound about a workpiece, comprising a wire winding tool, wherein the wire includes opposed free ends, and is adapted to form a loop, and is further adapted to form a winding, adapted to extend about the workpiece and through the loop and to be wound about the workpiece, wherein the wire winding tool comprises:

a body element, which includes a distal end which is generally tapered-shaped to form a tapered end, adapted to hold the wire loop in position during winding of the wire, and a cylindrical shaft, which is hollow, and includes interior threads and side slots, and from which the tapered end extends, wherein the cylindrical shaft of the body element further includes a proximal end, which includes flat side surfaces for enabling securing of a gripping member thereto;

a threaded shaft, adapted to extend in and threadably engage the interior threads of the hollow portion of the cylindrical shaft, and to be threadably movable relative to the body element, which threaded shaft includes a distal end, and transverse pins extending therefrom through the side slots in the body element, adapted to be moveable in the body element side slots and to enable the wire free ends to be secured thereto; and a nut, adapted to be threadably connected to the threaded shaft, and, upon threaded movement of the nut, to enable the threaded shaft to retract relative to the body element such that the transverse pins pull on the wire free ends secured thereto so as to wind the wire about the workpiece and enable the wire winding to be secured to the workpiece.

2. The article of claim 1, wherein the threaded shaft further includes a proximal end which is non-threaded, adapted to enable extension of a loop therethrough.

3. The article of claim 2, wherein the non-threaded proximal end of the threaded shaft has a hole therethrough for enabling extending a loop therethrough.

4. A method of enabling a wire to be wound about a workpiece, wherein the wire includes opposed free ends, and is adapted to form a loop, and is further adapted to form a winding, adapted to extend about the workpiece and through the loop and to be wound about the workpiece, in an article which comprises a wire winding tool, comprising a body element, which includes a distal end which is generally tapered-shaped to form a tapered end, adapted to hold the wire loop in position during winding of the wire, and a cylindrical shaft, which is hollow, and includes interior threads and side slots, and from which the tapered end extends, wherein the cylindrical shaft of the body element further includes a proximal end, which includes flat side surfaces for enabling securing of a gripping member thereto, a threaded shaft, adapted to extend in and threadably engage the interior threads of the hollow portion of the cylindrical shaft, and to be threadably movable relative to the body element, which threaded shaft includes a distal end, and transverse pins extending therefrom through the side slots in the body element, adapted to be moveable in the body element side slots and to enable the wire free ends to be secured thereto, and a nut, adapted to be threadably connected to the threaded shaft, and, upon threaded movement of the nut, to enable the threaded shaft to retract relative to the body element such that the transverse pins pull on the wire free ends secured thereto so as to wind the wire about the workpiece and enable the wire winding to be secured to the workpiece, wherein the method comprises:

forming a loop and a winding adapted to extend about the workpiece and through the loop and to be wound about the workpiece by the wire;

holding the wire loop in position during winding of the wire, by the body element tapered end;

enabling securing of a gripping member to the flat side surfaces of the proximal end of the body element cylindrical shaft;

threadably moving the threaded shaft along the interior threads of the cylindrical shaft hollow portion;

moving the threaded shaft transverse pins with the wire free ends secured thereto along the body element side slots; and threadably moving the nut along the threaded shaft and retracting the threaded shaft relative to the body element, so as to pull the transverse pins with the wire free ends secured thereto, wind the wire about the workpiece, and secure the wire winding to the workpiece.

5. The method of claim 4, wherein the threaded shaft further includes a proximal end which is non-threaded, adapted to enable extension of a loop therethrough, further comprising enabling extension of a loop through the non-threaded proximal end of the threaded shaft.

6. The method of claim 5, wherein the non-threaded proximal end of the threaded shaft has a hole therethrough for enabling extension of a loop therethrough, and wherein enabling extension of the loop includes enabling extension of the loop through the hole in the non-threaded proximal end of the threaded shaft.

* * * * *